United States Patent [19]

Canfield et al.

[11] Patent Number: 4,531,047

[45] Date of Patent: Jul. 23, 1985

[54] CLIP-MOUNTED QUARTZ TUBE ELECTRIC HEATER

[75] Inventors: Douglas M. Canfield, Suffern, N.Y.; Joseph Gialanella, North Caldwell, N.J.

[73] Assignee: Casso-Solar Corporation, Pomona, N.Y.

[21] Appl. No.: 402,568

[22] Filed: Jul. 28, 1982

[51] Int. Cl.[3] ..... H05B 3/44

[52] U.S. Cl. ..... 219/354; 219/347; 219/355; 219/358; 219/548; 219/553; 338/268

[58] Field of Search ..... 219/354, 355, 357, 542, 219/544, 356, 358, 553, 548, 339, 342, 343, 347-353, 377, 546, 464; 338/234, 235, 236, 237, 268; 313/274, 271

[56] References Cited

U.S. PATENT DOCUMENTS

| | | | |
|---|---|---|---|
| 631,360 | 8/1899 | Creveling | 219/347 |
| 1,431,407 | 10/1922 | McClatchie | 219/546 |
| 1,652,503 | 12/1927 | Sutherland | 219/548 |
| 2,034,612 | 3/1936 | Fogg | 219/355 |
| 2,051,637 | 8/1936 | Goldbert et al. | 219/347 |
| 2,209,832 | 7/1940 | Schurig | 219/464 |
| 2,658,984 | 11/1953 | Mohn | 219/354 |
| 2,894,107 | 7/1959 | Lefebvre | 219/354 |
| 2,953,670 | 9/1960 | Kelley | 219/544 |
| 3,217,139 | 11/1965 | Barber | 219/354 |
| 3,303,324 | 2/1967 | Appleman | 338/252 |
| 3,335,261 | 8/1967 | Siegla et al. | 219/464 |
| 3,461,275 | 8/1969 | Poole | 219/354 |
| 3,699,309 | 10/1972 | Eck | 219/354 |
| 3,718,497 | 2/1973 | Rice | 219/355 |
| 3,846,621 | 11/1974 | Roos | 219/544 |
| 4,241,292 | 12/1980 | Kreick et al. | 219/354 |
| 4,349,727 | 9/1982 | Churchill | 219/544 |

FOREIGN PATENT DOCUMENTS

| | | | |
|---|---|---|---|
| 453450 | 12/1948 | Canada | 219/542 |
| 2950302 | 6/1981 | Fed. Rep. of Germany | 219/464 |
| 910261 | 11/1944 | France | 219/354 |
| 1188729 | 12/1957 | France | 219/354 |
| 222902 | 7/1964 | Sweden | 219/356 |
| 305300 | 2/1929 | United Kingdom | 219/354 |

*Primary Examiner*—Roy N. Envall, Jr.
*Assistant Examiner*—Geoffrey S. Evans
*Attorney, Agent, or Firm*—Karl F. Ross; Herbert Dubno

[57] ABSTRACT

An electric heater has an elongated cylindrical quartz tube provided at each end with a terminal and a heater coil having one end connected at each terminal has a helical portion disposed within the tube and extending the length thereof. A ceramic support disposed in the tube extends the length of the helical portion of the coil and is formed with a heat-reflecting longitudinal groove having mutually inclined opposing sides which flank at least a portion of the circumference of the turns of the helical portion. Each of the opposing sides of the groove engage the turns of the helix tangentially in point contact, the support holding the helical portion with the turns thereof in tangential point contact with the inner surface of the tube. Each turn of the helical portion is supported at three separate points.

4 Claims, 6 Drawing Figures

CLIP-MOUNTED QUARTZ TUBE ELECTRIC HEATER

FIELD OF THE INVENTION

The present invention relates, in general, to electric heaters, and, more specifically, to a clip-mounted quartz tube heater having a helical heating coil disposed within the quartz tube.

BACKGROUND OF THE INVENTION

Quartz tube electric heaters are well known in the art and usually comprise a quartz tube in which a heater wire is suspended. In an effort to obtain greater heat output, these heater wires are sometimes formed as helical coils which are suspended in the tube. However, at the high temperatures at which these heaters operate, the resistance wires suffer a reduction in stiffness and the unsupported turns of the helix tend to collapse, losing their symmetry, which causes "hot spots" in the wire and further loss of symmetry, until a burn-out of the coil occurs.

Another disadvantage of conventional quartz tube heaters is that they radiate heat over 360°, when a more limited area of radiation is usually desired. In an effort to overcome this drawback, external reflectors are positioned around a portion of the circumference of the quartz tube, but these reflectors usually become tarnished and dirty, losing their efficiency.

A good example of efforts to overcome these disadvantages can be seen in U.S. Pat. No. 3,699,309, in which a coil is disposed within a quartz tube between a reflective body therein and the inner surface of the tube, the reflective body having a planar surface.

The disadvantage of this example is that the coil is only supported at two diametrically opposite points of the turns thereof, so that the coil can still collapse between these points, becoming elliptical instead of circular, while the planar reflective surface gives a radiation spread of no less than 180°, which for most applications is still too wide.

A still further disadvantage of the known quartz tube heaters is the fact that the tubes are mechanically mounted within the heater housing, so that if a burn-out of the quartz tube occurs, which is more likely in these types of heaters, removal of the heater is awkward and time consuming.

OBJECTS OF THE INVENTION

It is, therefore, an object of the present invention to provide an improved quartz tube heater in which the coil thereof is prevented from collapsing.

It is another object of the present invention to provide a quartz tube heater in which the angle of reflected radiation is less than 180°.

It is still another object of the invention to provide a quartz tube heater element which can easily be removed from the heater housing.

SUMMARY OF THE INVENTION

The above and other objects of the invention are attained in a quartz tube heater in which the tube thereof is elongated and cylindrical and is provided at each end with a terminal to which is connected an end of a heater coil having a helical portion disposed within the tube and extending the length thereof.

A ceramic support disposed in the tube extends the length of the helical portion of the coil and is formed with a heat-reflecting longitudinal groove having mutually inclined opposing sides which flank at least a portion of the circumference of the turns of the helical portion, each of the opposing sides engaging the turns of the helix tangentially in point contact, the support holding the helical portion with the turns thereof in tangential point contact with the inner surface of the tube, whereby each turn of the helical portion is supported at three separate points.

The end terminals on the tube are each comprised by a cylindrical ceramic cap fitted over the end of the tube and formed with an opening through which an end of the heater coil can be extended and directly connected to a metal sleeve fitted over a portion of the cap or connected thereto through an intermediate terminal. A metal spring clip mounted on a ceramic block has opposing curved arms adapted to removably engage the metal sleeve and forms a mounting for the quartz heating tube.

BRIEF DESCRIPTION OF THE DRAWING

The above and other objects, features and advantages of the invention will become more readily apparent from the following description, reference being made to the accompanying drawing, in which.

SPECIFIC DESCRIPTION

Figure 1:
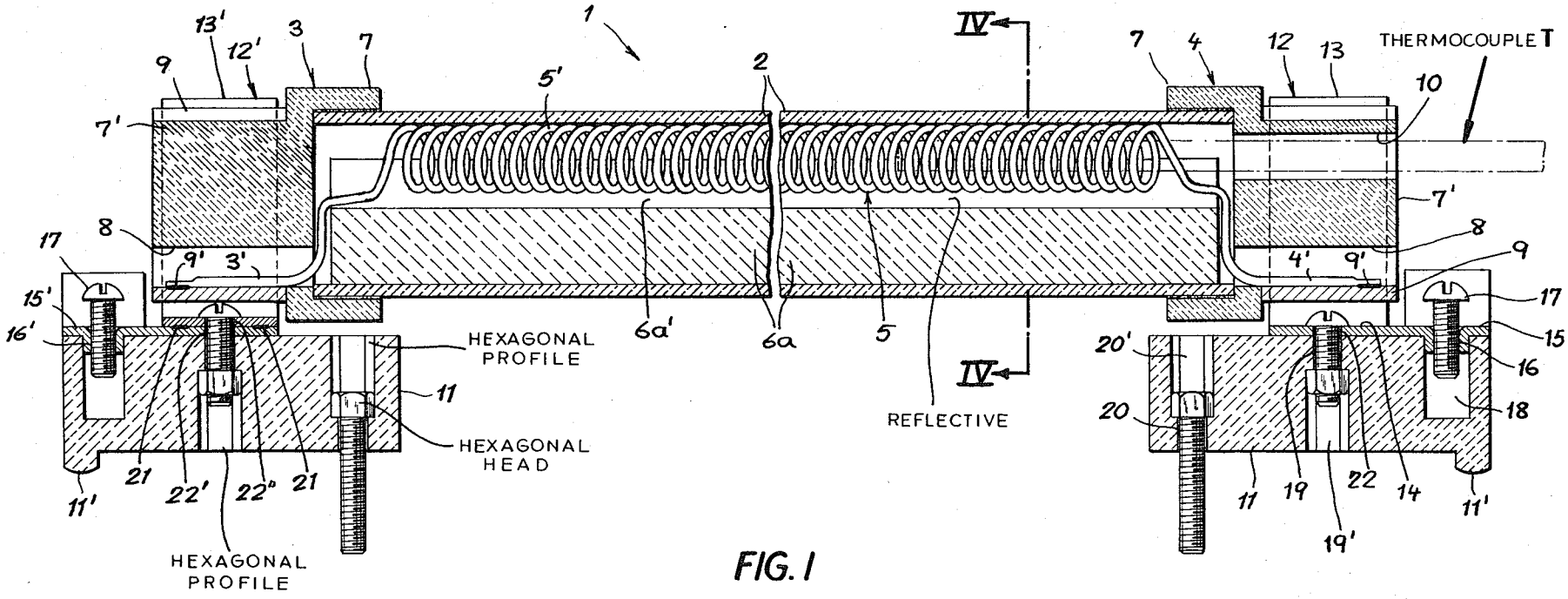
FIG. 1 is an axial sectional view through a quartz heater tube, according to the invention.
Figure 2:
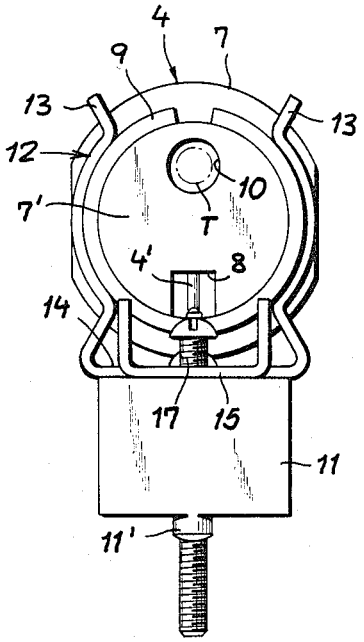
FIG. 2 is an end view taken from the right side of FIG. 1, showing one embodiment of the spring clip of an end terminal.
Figure 3:
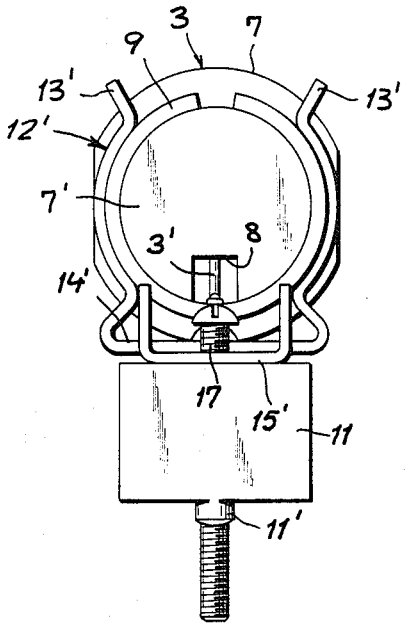
FIG. 3 is an end view taken from the left side of FIG. 1, showing another embodiment of the spring clip of an end terminal.

FIG. 1 of the drawing shows an axial section through a quartz heater tube generally designated 1, and comprises an elongated cylindrical quartz tube 2 provided at each end with a respective terminal generally designated 3 and 4.

A heater coil 5 has a helical portion 5' disposed in the tube 2 and extending the length thereof, with ends 3' and 4' connected respectively to terminals 3 and 4 directly or through an intermediate terminal.

Figure 4:
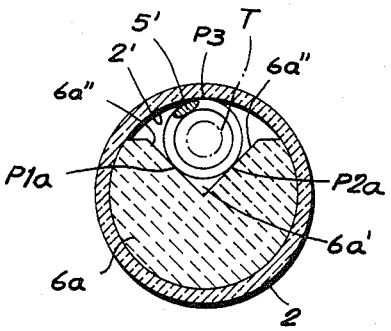
FIG. 4 is a sectional view taken along line IV—IV of FIG. 1, showing one embodiment of the support.

A support **6*a* of ceramic or other refractory material is disposed in the tube 2 and extends the length of helical portion 5' of the coil 5, and is formed with a heat-reflecting longitudinal groove 6*a'*, which extends the length of the support and has mutually inclined opposing sides 6*a''* forming a V, which can best be seen in FIG. 4, the sides 6*a''* flanking at least a portion of the circumference of the turns of the helical portion 5', each of the opposing sides 6*a''* engaging the turns of the helix tangentially in point contact, the support 6*a* holding the helical portion 5' with the turns thereof in tangential point contact with the inner surface 2' of the tube 2, whereby each turn of the helical portion 5' is supported at three separate points P1*a*, P2*a* and P3, point P3** always being in the same 12 o'clock high position in all the embodiments of the support.

The end terminals 3 and 4 each comprised by a ceramic cap 7, fitted over an end of the tube 2 and cemented in place. The caps 7 have an axially extending portion 7' of reduced diameter, in the surface of which there is formed a longitudinal channel 8 which communicates with the interior of tube 2 and through which respective ends 3' and 4' of the coil 5 are drawn and spotwelded at 9' to split metal sleeves 9, which are of a slightly smaller diameter than axially extending portions 7' and are force-fitted thereon. The caps 7 are also provided with passageways 10 lying in axial alignment with the longitudinal axis of helical portion 5', and through which a thermocouple T, shown in phantom lines in FIG. 1, can be fitted to extend within the turns of the helix.

Identical ceramic mounting blocks 11 form part of respective terminals 3 and 4 and are mounted on a heater housing not shown in the drawing but understood to be of a standard type for quartz tube heaters.

Mounted on the block 11 of terminal 4 is a metal spring clip 12 having curved opposing arms 13 connected by a web 14 and adapted to removably engage the sleeve 9. A tongue 15 extends laterally from web 14 and is provided with a threaded opening 16, which receives the screw terminal 17 for the power connection. The screw terminal 17 extends into a recess 18 formed in the block 11 for this purpose, while a bore 19 formed in the block lies in alignment with an opening 22 formed in the web 14, through which a threaded fastener extends into an enlarged hexagonal portion 19' and engages a nut held against rotation therein, this serving to fasten the spring clip in place on the block with the nut recessed from the lower surface of the block to avoid short circuiting. Another bore 20 in the block also has an enlarged hexagonal portion 20', which receives in a recessed fashion the hexagonal head of a bolt which fastens the block 11 to the heater housing, the block being oriented thereon by an indexing projection 11'.

The cap 7 and block 11 of end terminal 3 are identical to those of terminal 4 and need not be described in further detail, except to say that the end 3' of coil 5 is received in the channel 8 and spotwelded at 9' to sleeve 9. However, spring clip 12' of terminal 3 differs from that of the spring clip 12 of terminal 4 in that the spring clip 12' is of two-piece construction, with the opposing curved arms 13' and connecting web 14' being unitary and spotwelded at 21 to the laterally extending tongue 15', which underlies the web 14' and has an opening 22' therein in alignment with an opening 22'' formed in the web 14', these openings serving the same purpose as opening 22. The tongue 15' is also provided with a threaded opening 16' for receiving a screw terminal 17. Except for the unitary and two-piece construction of respective spring clips 12 and 12', their function and operation are identical.

Figure 5:
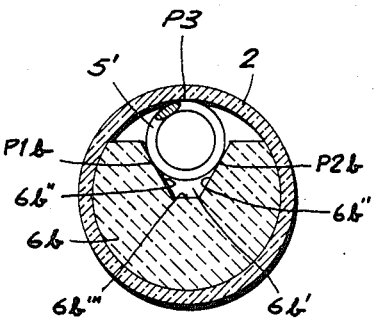
FIG. 5 is a sectional view similar to FIG. 4, showing another embodiment of the support.

In FIG. 5 there is shown another embodiment of the invention in which the ceramic support **6*b* is formed with a heat-reflecting longitudinal groove 6*b'*, which extends the length of the support and has mutually inclined opposing sides 6*b''*, which are joined by another side 6*b'''* to define therewith a trapezoid. In this particular feature of the invention, the contact points P3, P1*b* and P2*b*** are equally spaced around the turns of the coil.

Figure 6:
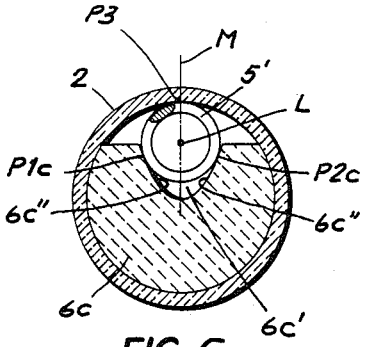
FIG. 6 is a sectional view similar to FIG. 5, showing still another embodiment of the support.

In FIG. 6 there is shown still another embodiment of the invention in which the ceramic support **6*c* is formed with a longitudinal groove 6*c'*, in which the mutually inclined opposing sides 6*c''* are curved and join to form a portion of an ellipse in which the major axis M thereof lies coplanar with the longitudinal axis L of the helical portion 5' of coil 5. In this embodiment, point contact is made with the turns of helical portion 5' at P3, P1*c* and P2*c***.

FIGS. 4, 5 and 6 show with particular clarity the three point contact with the coil in all of the embodiments, which offer superior support to the coil which will greatly reduce collapsing of the turns thereof, while the different groove configurations offering that support also reflect the heat in the much more desirable narrow band width in which the heat can be concentrated where it is needed most.

In operation, the quartz tube heater is used like any standard electric heater, except that the quartz tube is held in place in a heater housing by the spring clips which allow the tube to be snapped in and out of place in case of a burn-out of the resistance element, which is analogous to changing a light bulb in a lamp, rather than throwing the lamp away.

I claim:

1. An electrical heater comprising:

an elongated cylindrical quartz tube;

a pair of terminals, one terminal being provided at each end of said elongated cylindrical quartz tube;

a heater coil having one end connected at each of said terminals and a helical portion within said elongated cylindrical quartz tube and extending the length thereof; and a ceramic support provided in said elongated cylindrical quartz tube and extending the length of said helical portion, said ceramic support being formed with a heat-reflecting longitudinal groove having mutually inclined opposing sides which flank at least a portion of the circumference of the turns of said helical portion, each of said opposing sides engaging the turns of the helix tangentially in point contact, said ceramic support holding said helical portion with the turns thereof in tangential point contact with the inner surface of said elongated cylindrical quartz tube, whereby each turn of said helical portion is supported at three separate points, each of said terminals comprising:

a cylindrical ceramic cap fitted over an end of said elongated cylindrical quartz tube and formed with an opening through which an end of said heater coil can be extended, a metal sleeve fitted over a portion of said cap and connected to said end of said heater coil, and a metal spring clip mounted on a ceramic block and having opposing curved arms adapted to removably engage said metal sleeve and forming a mounting for said elongated cylindrical quartz tube, said portion of said cap extending axially and being cylindrical and of reduced diameter and said opening being a channel formed in the surface thereof and communicating with the interior of said elongated cylindrical quartz tube, and said sleeve being of slightly smaller diameter than said portion and being provided with a longitudinal split for allowing said sleeve to be force-fitted over said portion and overlying said channel, whereby said end of said heater coil is connected thereto, said cap being further provided with a second opening in axial alignment with the longitudinal axis of said heater coil for mounting a thermocouple therein extending within the turns of said helical portion.

2. The heater defined in claim 1 wherein said arms of said spring clip are connected by a web having a tongue extending laterally therefrom, said tongue being formed with a threaded opening receiving a screw terminal for providing electrical connection to said heater and a second opening formed in said web between said arms for bolting said spring clip to said ceramic block, said spring clip being of unitary construction.

3. The heater defined in claim 1 wherein said arms of said spring clip are connected by a web, said spring clip being further provided with a tongue fastened to said web and extending laterally therefrom, said tongue being formed with a threaded opening receiving a screw terminal for providing electrical connection to said heater and a second opening formed in said web between said arms and in alignment with a third opening formed in said tongue for bolting said spring clip to said ceramic block.

4. The heater defined in claim 2 or claim 3 wherein said ceramic block comprises a recess for receiving the end of said screw terminal enabling said spring clip to lie flush on a first surface of said block, a first throughgoing bore formed in said first surface in alignment with said second opening in said web, said first bore having an enlarged end portion formed at a second surface opposite said first surface, said enlarged end portion having a hexagonal profile for receiving and holding a nut recessed from said second surface against rotational movement, a second throughgoing bore formed in said second surface and having an enlarged end portion formed at said first surface, said enlarged end portion of said second bore having a hexagonal profile for receiving and holding against rotation the hexagonal head of a bolt recessed from said first surface, and an indexing projection formed on said second surface remote from the enlarged end portion of said second bore.

* * * * *